US006334545B1

(12) United States Patent
Fisher et al.

(10) Patent No.: US 6,334,545 B1
(45) Date of Patent: Jan. 1, 2002

(54) FLARE DISPENSING AND IGNITING SYSTEM

(76) Inventors: William E. Fisher; Maggie Fisher, both of 3054 Marie Ct., Merced, CA (US) 95340

( * ) Notice: Subject to any disclaimer, the term of this patent is extended or adjusted under 35 U.S.C. 154(b) by 0 days.

(21) Appl. No.: 09/490,241

(22) Filed: Jan. 24, 2000

(51) Int. Cl.[7] ..... A24F 27/14
(52) U.S. Cl. ..... 221/136; 221/342
(58) Field of Search ..... 221/135, 136, 221/137, 139, 140, 141, 143; 102/342, 343, 336

(56) References Cited

U.S. PATENT DOCUMENTS

| | | | | |
|---|---|---|---|---|
| 2,002,492 | A | | 5/1935 | Dess |
| 3,298,307 | A | | 1/1967 | Hunt |
| 3,319,596 | A | | 5/1967 | Walter |
| 3,628,416 | A | | 12/1971 | Kernan |
| 3,635,189 | A | | 1/1972 | Whittemore |
| 3,698,317 | A | * | 10/1972 | Finch ..... 102/37.4 |
| 3,808,941 | A | | 5/1974 | Biggs |
| 3,921,325 | A | | 11/1975 | Tennigkeit |
| 4,069,761 | A | | 1/1978 | Jimenez |
| 4,959,756 | A | | 9/1990 | Dodspn ..... |

* cited by examiner

*Primary Examiner*—Kenneth W. Noland

(57) ABSTRACT

A flare dispensing and igniting system comprising a housing for holding a plurality of flares for dispensing. The housing has side walls, end walls and a bottom wall, and a dispensing opening in the bottom wall. A dispensing plate covers a portion of the dispensing opening, with a closed position adjacent to the dispensing opening for preventing flare movement through the dispensing opening. The dispensing plate is pivotable away from the dispensing opening to permit a flare to pass through the dispensing opening. An ejecting assembly is provided in the housing for ejecting flares from the housing and which includes a plunger assembly for pushing a flare through the dispensing opening and past the dispensing plate. The dispensing plate has an inner surface facing the dispensing opening, and the inner surface has an abrasive texture for abrading the end of a flare as the flare passes through the dispensing opening for igniting the flare as the flare is ejected from the interior of the housing.

19 Claims, 3 Drawing Sheets

FLARE DISPENSING AND IGNITING SYSTEM

BACKGROUND OF THE INVENTION

1. Field of the Invention

The present invention relates to flare dispensing systems and more particularly pertains to a new flare dispensing and igniting system for providing a convenient system for storing flares prior to use, and for dispensing and igniting the flares during use.

2. Description of the Prior Art

The use of flare dispensing systems is known in the prior art. More specifically, flare dispensing systems heretofore devised and utilized are known to consist basically of familiar, expected and obvious structural configurations, notwithstanding the myriad of designs encompassed by the crowded prior art which have been developed for the fulfillment of countless objectives and requirements.

Many of the known flare dispensing systems include means for igniting the flare when the flare is being dispensed from a housing holding a plurality of flares. However, many of these systems ignite the flare while the flare is located in the housing in which the plurality of flares are stored, which can be hazardous if some of the ignited material remains in the housing or is deflected back into the area of the housing where the plurality of flares are being held. This feature of the prior art can be especially hazardous if the ignited flare becomes lodged or jammed in the exit passageway of the housing. Thus, these systems can present a significant hazard to the user if the plurality of flares become ignited in the housing.

Further, many of the known flare dispensing systems are designed for a particular size of flare, and are not able to handle flares of different sizes. Thus, the use of different sized flares requires the user to have two or more of these known systems, one for each size of flares.

SUMMARY OF THE INVENTION

In view of the foregoing disadvantages inherent in the known types of flare dispensing systems now present in the prior art, the present invention provides a new flare dispensing and igniting system construction wherein the same can be utilized for providing a convenient system for storing flares prior to use, and for dispensing and igniting the flares during use.

The general purpose of the present invention, which will be described subsequently in greater detail, is to provide a new flare dispensing and igniting system apparatus and method which has many of the advantages of the flare dispensing systems mentioned heretofore and many novel features that result in a new flare dispensing and igniting system which is not anticipated, rendered obvious, suggested, or even implied by any of the prior art flare dispensing systems, either alone or in any combination thereof.

To attain this, the present invention generally comprises a flare dispensing and igniting system including a housing for holding a plurality of flares for dispensing. The housing has side walls, end walls and a bottom wall, and a dispensing opening in the bottom wall. A dispensing plate covers a portion of the dispensing opening, with a closed position adjacent to the dispensing opening for preventing flare movement through the dispensing opening. The dispensing plate is pivotable away from the dispensing opening to permit a flare to pass through the dispensing opening. An ejecting assembly is provided in the housing for ejecting flares from the housing and which includes a plunger assembly for pushing a flare through the dispensing opening and past the dispensing plate. The dispensing plate has an inner surface facing the dispensing opening, and the inner surface has an abrasive texture for abrading the end of a flare as the flare passes through the dispensing opening for igniting the flare as the flare is ejected from the interior of the housing.

In one embodiment of the invention, a guide wall is provided in the housing that slopes downwardly toward the dispensing opening such that flares resting on the guide wall are directed toward the dispensing opening. The guide wall may define a flare dispensing space above the guide wall and a flare storage space between the guide wall and the bottom wall of the housing, with the guide wall being pivotally attached to the bottom wall to permit pivoting of the guide wall to access the flare storage space.

In one embodiment, a biasing assembly is provided for biasing flares in the interior of the housing toward a first one of the end walls of the housing. The biasing assembly may comprises a biasing wall oriented substantially parallel to the end walls, with the biasing wall being oriented above the guide wall for contacting flares resting on the guide wall. A biasing member may be located between one of the end walls of the housing and the biasing wall for pressing the biasing wall toward the other of the end walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new flare dispensing and igniting system apparatus and method which has many of the advantages of the flare dispensing systems mentioned heretofore and many novel features that result in a new flare dispensing and igniting system which is not anticipated, rendered obvious, suggested, or even implied by any of the prior art flare dispensing systems, either alone or in any combination thereof.

It is another object of the present invention to provide a new flare dispensing and igniting system which may be easily and efficiently manufactured and marketed.

It is a further object of the present invention to provide a new flare dispensing and igniting system which is of a durable and reliable construction.

An even further object of the present invention is to provide a new flare dispensing and igniting system which is susceptible of a low cost of manufacture with regard to both materials and labor, and which accordingly is then susceptible of low prices of sale to the consuming public, thereby making such flare dispensing and igniting system economically available to the buying public.

Still yet another object of the present invention is to provide a new flare dispensing and igniting system which provides in the apparatuses and methods of the prior art some of the advantages thereof, while simultaneously overcoming some of the disadvantages normally associated therewith.

Still another object of the present invention is to provide a new flare dispensing and igniting system for providing a convenient system for storing flares prior to use, and for dispensing and igniting the flares during use.

Yet another object of the present invention is to provide a new flare dispensing and igniting system which includes a housing for holding a plurality of flares for dispensing. The housing has side walls, end walls and a bottom wall, and a dispensing opening in the bottom wall. A dispensing plate covers a portion of the dispensing opening, with a closed position adjacent to the dispensing opening for preventing flare movement through the dispensing opening. The dispensing plate is pivotable away from the dispensing opening to permit a flare to pass through the dispensing opening. An ejecting assembly is provided in the housing for ejecting flares from the housing and which includes a plunger assembly for pushing a flare through the dispensing opening and past the dispensing plate. The dispensing plate has an inner surface facing the dispensing opening, and the inner surface has an abrasive texture for abrading the end of a flare as the flare passes through the dispensing opening for igniting the flare as the flare is ejected from the interior of the housing.

Still yet another object of the present invention is to provide a new flare dispensing and igniting system for storing flares in a housing from which the flares can also be dispensed so that there is no need to transfer the flares out of a storage container for use.

Even still another object of the present invention is to provide a new flare dispensing and igniting system that is adjustable to hold flares of different sizes and dispense flares of different sizes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
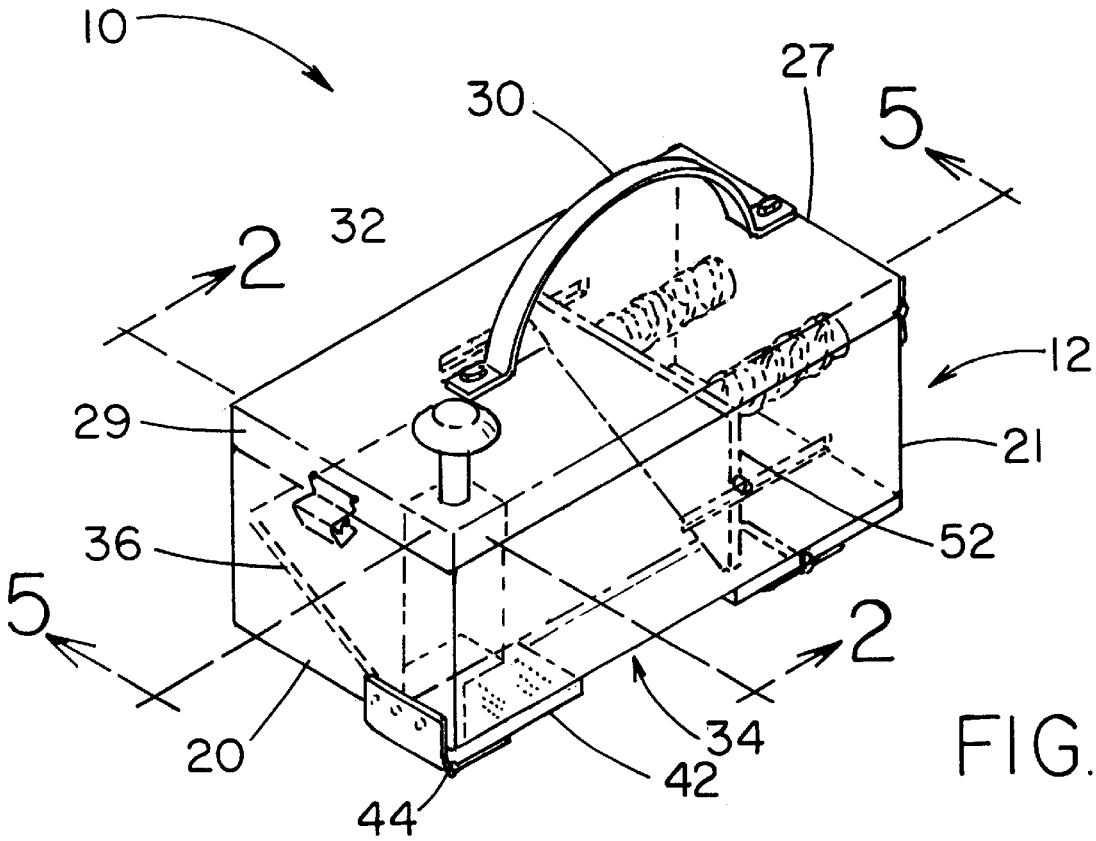
FIG. 1 is a schematic perspective view of the flare dispensing and igniting system of the invention.
Figure 2:
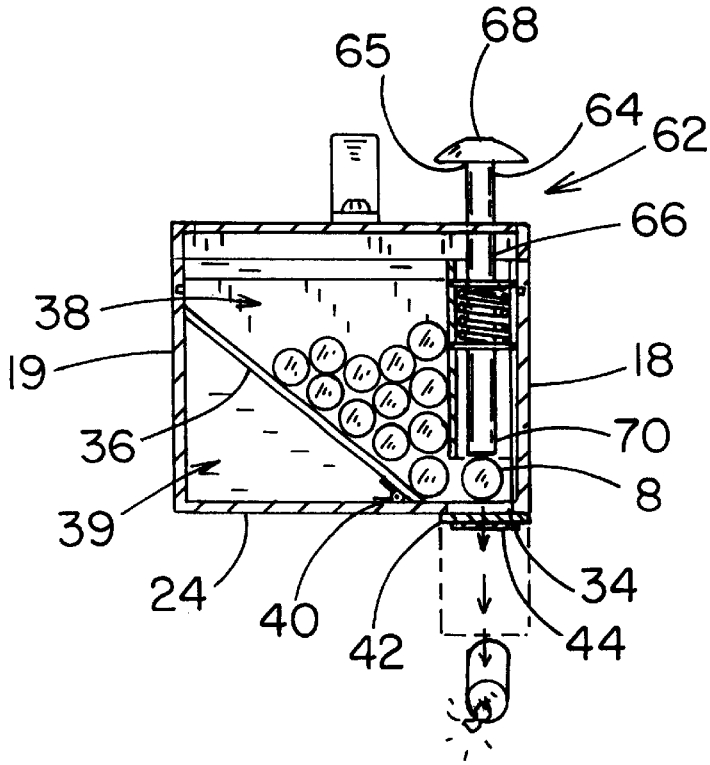
FIG. 2 is a schematic sectional view of the invention taken along line 2—2 of FIG. 1.
Figure 3:
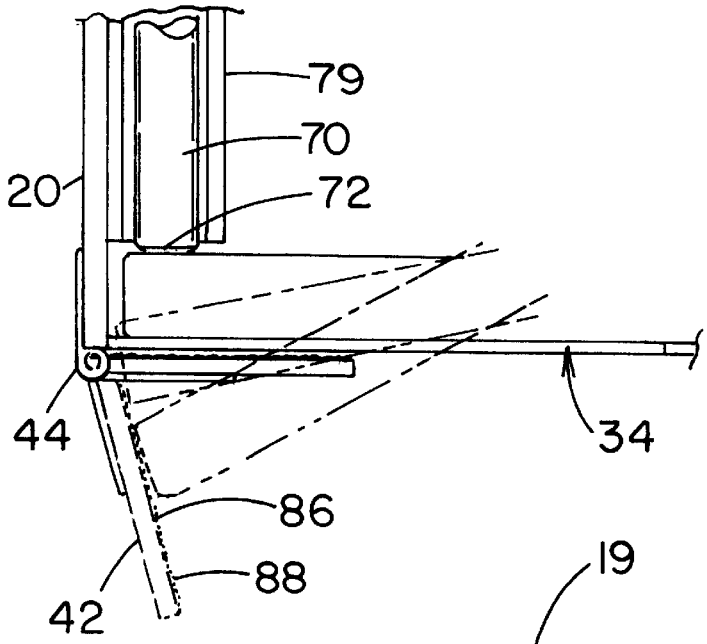
FIG. 3 is a schematic partial sectional view of a broken away portion of the housing and ejecting assembly of the present invention.
Figure 4:
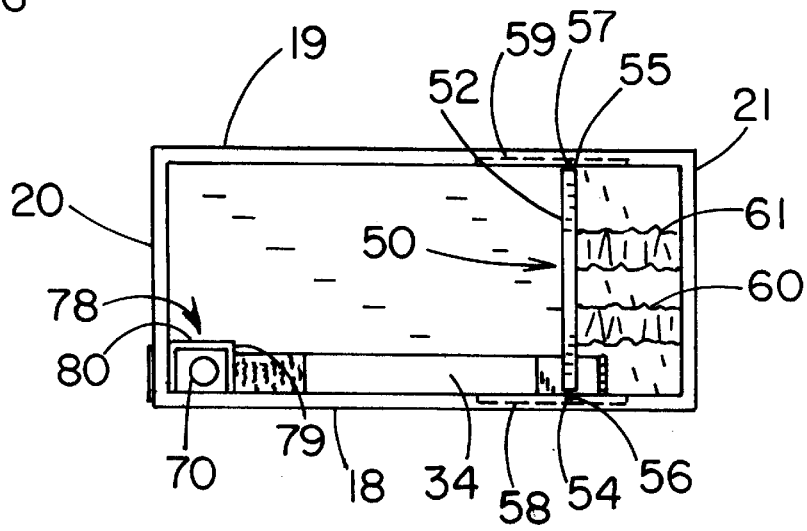
FIG. 4 is a schematic top view of the base portion of the housing of the invention with the lid portion removed to show the detail of the interior of the housing.
Figure 6:
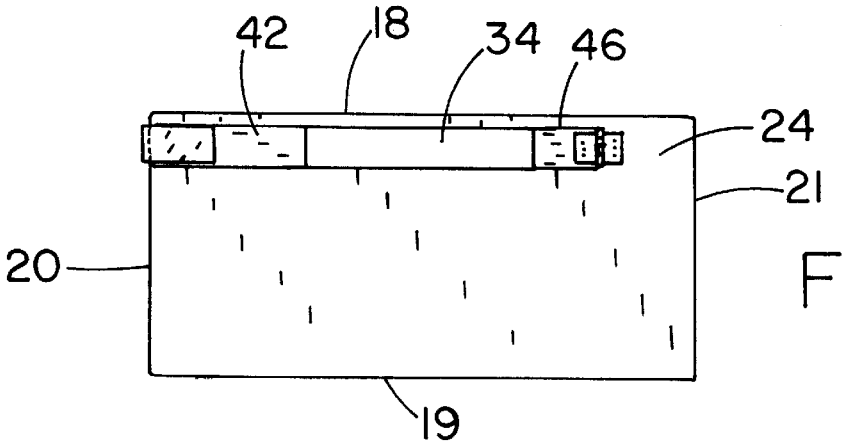
FIG. 6 is a schematic bottom view of the invention.
Figure 5:
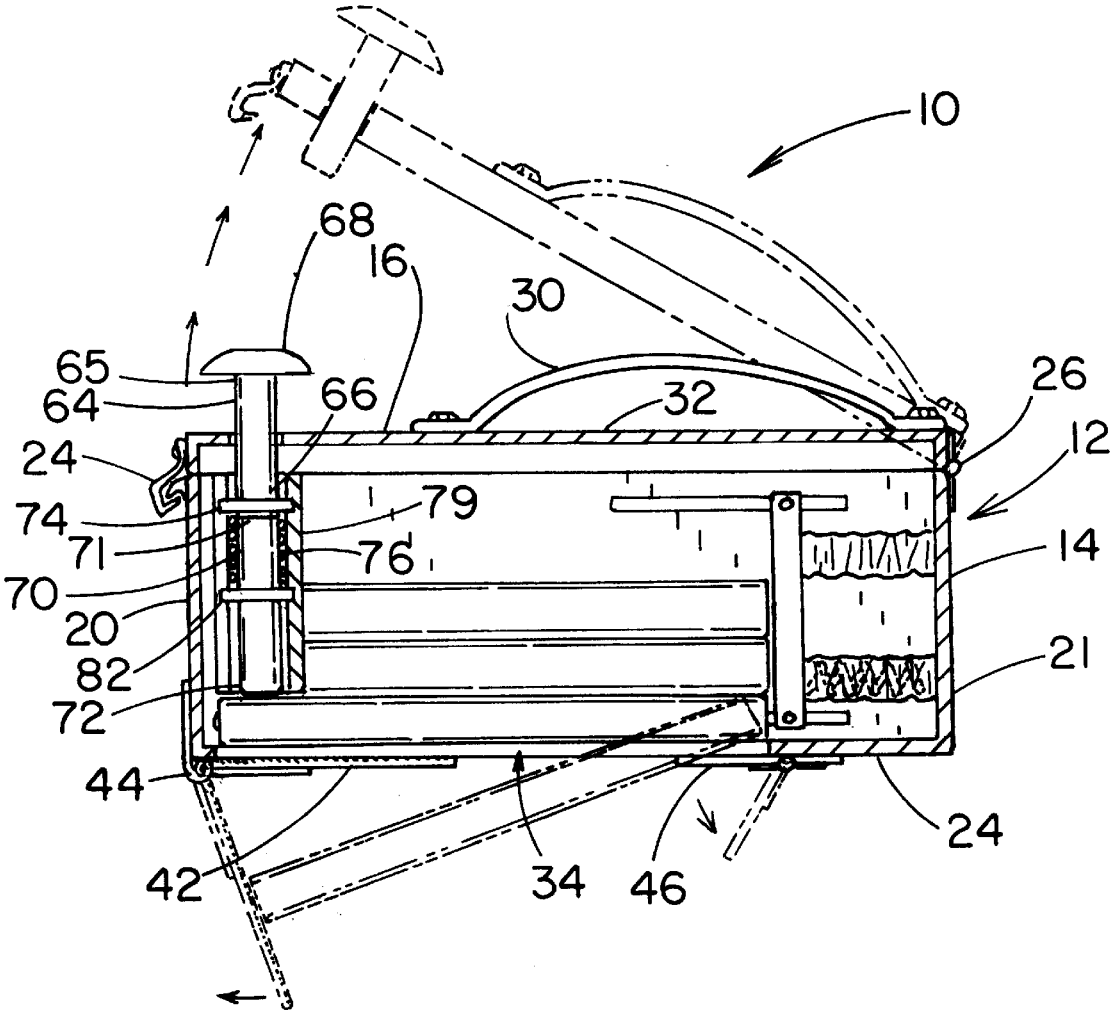
FIG. 5 is a schematic sectional view of the invention as taken along line 5—5 of FIG. 1 particularly showing the lid portion on the housing in a closed position and in an open position in phantom lines.

With reference now to the drawings, and in particular to FIGS. 1 through 6 thereof, a new flare dispensing and igniting system embodying the principles and concepts of the present invention and generally designated by the reference numeral 10 will be described.

As best illustrated in FIGS. 1 through 6, the flare dispensing and igniting system 10 generally comprises a housing 12 with a base portion 14 and a lid portion 16, and the base portion has a dispensing opening 34. A biasing assembly 50 is provided, and an ejecting assembly is provided for ejecting flares 8 from the housing 12. Significantly, the flare dispensing and igniting system 10 of the invention both stores flares prior to use of the flares, and then dispenses the flares in a one by one fashion while igniting the flares are dispensed.

The flare dispensing and igniting system 10 includes a housing 12 having an interior for holding a plurality of flares prior to the dispensing of the flares. The housing 12 has a base portion 14 and a lid portion 16 positioned above and resting on the base portion. The base portion has a pair of spaced side walls 18, 19 and a pair of spaced end walls 20, 21 that extend between the side walls. A bottom wall 24 extends between and joins the end walls 20, 21 and side walls 18, 19.

A hinge assembly 26 pivotally couples the lid portion 16 to the base portion 14. The hinge assembly is mounted on one of the end walls 20, 21 of the base portion of the housing and a first end 27 of the lid portion. A latch assembly 28 is provided for selectively securing the lid portion to the base portion in a closed position, such as for the purpose of retaining the flares in the interior of the housing. The latch assembly 28 is mounted on an end wall 20 of the housing opposite the end wall on which the hinge assembly 26 is mounted. The latch assembly 28 is mounted on a second end 29 of the lid portion 16 opposite the first end 27 on which the hinge assembly 26 is mounted. A carrying handle 30 is mounted on a top surface 32 of the lid portion 16 for permitting lifting of the housing when the lid portion is in a closed position and the latch assembly 28 is latched.

A significant feature of the housing 12 is a dispensing opening 34 for permitting flares stored in the interior of the housing 12 to exit through the bottom wall 24 of the housing while, for example, the housing is being carried by a user. The dispensing opening 34 may be preferably formed in the bottom wall 24 of the housing adjacent to a first one 18 of the side walls of the housing. The dispensing opening 34 may extend substantially the entire distance between the end walls 20, 21, although it is not necessary that the dispensing opening extend the entire distance. Suitably, the dispensing opening 34 may extend only a distance sufficient for a flare 8 to pass through the opening 34.

A guide wall 36 extends from the second side wall 19 of the housing toward the first side wall 18. The guide wall 36 slopes downwardly toward the dispensing opening 34 such that flares 8 resting on the guide wall 36 in the interior of the housing are directed toward the dispensing opening such that as a flare is moved through the opening, another flare will take the position of the ejected flare above the dispensing opening. The guide wall 36 defines a flare dispensing space 38 above the guide wall for flares that are available for dispensing, and a flare storage 39 space between the guide wall 36 and the bottom wall 24 for flares which may be moved into the flare dispensing space 38 for dispensing. The guide wall 36 is pivotally attached to the bottom wall 24 to permit pivoting of the guide wall in an upward direction away from the bottom wall to permit access to the flare storage space. Preferably, the guide wall 36 is pivotally connected by a pivot assembly 40 to the bottom wall at a location adjacent to the dispensing opening 34.

A dispensing plate 42 is provided for covering at least a portion of the dispensing opening 34. The dispensing plate 42 is pivotally mounted to the housing adjacent to an end of the dispensing opening, and preferably the end of the dispensing opening adjacent the end wall 20. The dispensing plate 42 has a closed position in which the plate 42 is positioned adjacent to the dispensing opening for supporting a portion of the flare 8 positioned above the dispensing opening 34, and thereby preventing the flare from moving through the dispensing opening 34. The dispensing plate is pivotable away from the dispensing opening to permit a flare to pass through the dispensing opening, and the plate is biased into the closed position. Preferably, the dispensing plate is mounted by a spring hinge 44 to the housing.

Optionally, a retaining plate 46 may be positioned at an end of the dispensing opening 34 opposite the end of the opening on which the dispensing plate 42 is mounted. The retaining plate 42 is thus adapted to support an end of a flare positioned above the dispensing opening, while the dispensing plate supports the opposite end of the flare. As a further option, the retaining plate may be pivotally mounted to the bottom wall 24 of the housing 12 adjacent to the end of the dispensing opening, although the retaining plate may be fixedly mounted so as not to permit movement of the dispensing plate. The pivoting retaining plate embodiment may have a spring hinge biasing the retaining plate into a position adjacent the dispensing opening.

A biasing assembly 50 is provided for biasing the flares located in the interior of the housing toward a first one 20 of the end walls of the housing, which permits the invention to securely accommodate flares of different lengths. The biasing assembly 50 comprises a biasing wall 52 that may be oriented substantially parallel to the end walls 20, 21 of the housing. The biasing wall 52 may be oriented above the guide wall 36 for contacting flares resting on the guide wall. The biasing wall 52 has opposite side edges 54, 55, and each of the side edges have a guide tab 56, 57 extending from the respective side edge 54, 55. The side walls 18, 19 of the housing each have a guide slot 58, 59 for accepting one of the guide tabs 56, 57 of the guide wall 36.

A biasing member 60, 61 is located between the second end wall 19 and the biasing wall 52 for pressing the biasing wall toward the first end wall 20 to automatically adjust the size of the flare dispensing space 38 to the length of the flares positioned in the flare holding space. In one embodiment of the invention, a pair of biasing members 60, 61 extend between the second end wall and the biasing wall for providing a more evenly distributed pressure on the flares in the flare holding space. Optionally, the biasing member may comprise a compression spring.

An ejecting assembly may be provided in the housing for ejecting flares from the interior of the housing through the dispensing opening. The ejecting assembly includes a plunger assembly 62 for pushing a flare through the dispensing opening 34. The plunger assembly 62, in turn, includes a plunger actuator 64 for actuating the plunger assembly. The plunger actuator 64 has a portion that extends through the lid portion 16 of the housing 12, and a first end 65 of the actuator 64 is located external to the housing. A button 68 is mounted on the first end 65 of the plunger actuator for being pressed by the user. The plunger actuator has a second end 66 which extends into and is positioned in interior of the housing.

A push member 70 is provided for pushing a flare 8 positioned adjacent to the dispensing opening 34 through the opening 34 and past the dispensing plate 42. The push member 70 extends substantially parallel to the side wall 18 adjacent to the dispensing opening, and is thus oriented substantially vertically. The push member 70 has a first end 71 for pushing against a flare 8 positioned above the dispensing opening 34. A push plate 74 is mounted on a second end 72 of the push member 70, and the push plate 74 is positioned below the push member 70 such that the second end 66 of the plunger actuator is abuttable against the push plate 74. The plunger actuator 64 pushes downwardly against the push plate 74 and the push member 70 when the user pushes down on the button 68 on the exterior of the housing.

A biasing element 76 is provided for biasing the push member in a direction away from the dispensing opening 34, or toward an uppermost position of the range of travel of the push member. The uppermost position of the push member permits a flare to move into position below the push member and over the dispensing opening when the plunger assembly is not being actuated. Thus, a flare is always ready to be ejected from the housing, and if any flares are in the flare dispensing space, a flare will be visible through the dispensing opening. One embodiment of the biasing element comprises a compression spring encircled about the push member.

A support structure 78 is provided for supporting the plunger assembly in the interior of the housing. The support structure includes a first wall 79 and a second wall 80, with the first 79 and second 80 walls forming a chamber with a side wall 18 and an end wall 20 of the housing. The support structure 78 includes a support wall 82 that extends in a plane oriented substantially perpendicular to a longitudinal axis of the push member 70, and the push member extends through the support wall such that the support wall helps to guide the movement of the push member. The biasing element (such as, for example, a compression spring) is positioned between the support wall 82 and the push plate 74 for biasing the push plate upwardly away from the support wall 82.

Significantly, the dispensing plate 42 has an inner surface 86 facing the dispensing opening 34, and the inner surface 86 has an abrasive 88 texture for abrading the end of a flare 8 as the flare passes through the dispensing opening 34 and rubs against the inner surface of the dispensing plate 42. The pivoting dispensing plate is thus ideally positioned for contacting the face of the end of the flare 8 after the flare has moved out of the dispensing opening and away from the flares remaining in the housing. Thus, the flare is ignited after at least the ignitable end of the flare has moved out of the housing, and cannot be jammed or remain in the housing.

In use, the lid portion of the housing is opening by releasing the latch assembly and pivoting the lid portion into an opening position, and one or more flares are placed in the flare dispensing space from an external source, or from the flare storage space internal to the housing accessed by pivoting the guide wall. When one or more flares are needed to be dispensed, the user pushes the button toward the lid portion of the housing, and the ejecting assembly pushes against the flare positioned in the housing above the dispensing opening and resting on the dispensing plate. This flare is pushed against the dispensing plate, and the dispensing plate pivots away from the dispensing opening. As the flare moves past the dispensing plate toward the ground surface, the end face of the flare slides across the abrasive surface of the dispensing plate and is ignited by the abrasive friction. As the push member is released, and the flare moves past the dispensing plate, the dispensing plate is biased back into a closed position. Another flare moves into position above the dispensing opening on the dispensing plate, until the ejecting assembly is again actuated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A flare dispenser system for storing and dispensing flares, the system comprising:

a housing for holding a plurality of flares for dispensing, the housing having an interior, the housing having a base portion and a lid portion, the base portion having side walls, end walls and a bottom wall joining the end walls and side walls, the housing having a dispensing opening in the bottom wall, a dispensing plate for covering a portion of the dispensing opening, the dispensing plate being pivotally mounted to the housing adjacent to an end of the dispensing opening, the dispensing plate having a closed position adjacent to the dispensing opening for preventing flare movement through the dispensing opening and the dispensing plate being pivotable away from the dispensing opening to permit a flare to pass through the dispensing opening;

an ejecting assembly in the housing for ejecting flares from the housing, the ejecting assembly including a plunger assembly for pushing a flare through the dispensing opening and past the dispensing plate; and a biasing assembly for biasing flares in the interior of the housing toward a first one of the end walls of the housing, the biasing assembly comprising a biasing wall oriented substantially parallel to the end walls, the biasing wall being oriented above the guide wall for contacting flares resting on the guide wall;

wherein the dispensing plate has an inner surface facing the dispensing opening, the inner surface having an abrasive texture for abrading the end of a flare passing through the dispensing opening for igniting the flare as the flare is ejected from the interior of the housing.

2. The flare dispenser system of claim 1 additionally comprising a hinge assembly for pivotally coupling the lid portion to the base portion, a latch assembly for selectively securing the lid portion to the base portion in a closed position, and a carrying handle mounted on a top surface of the lid portion for permitting lifting of the housing.

3. The flare dispenser system of claim 1 additionally comprising a retaining plate positioned at an end of the dispensing opening opposite the dispensing plate, the retaining plate supporting an end of a flare positioned above the dispensing opening.

4. The flare dispenser system of claim 3 wherein the retaining plate is pivotally mounted to the bottom wall of the housing adjacent to the end of the dispensing opening.

5. The flare dispenser system of claim 1 wherein the biasing wall has opposite side edges, each of the side edges of the guide wall having a guide tab extending from the side edge, the side walls of the housing each having a guide slot for accepting one of the guide tabs of the guide wall for guiding the biasing wall in a path substantially parallel to the guide wall.

6. The flare dispenser system of claim 1 additionally comprising a biasing member located between one of the end walls of the housing and the biasing wall for pressing the biasing wall toward the other of the end walls.

7. The flare dispenser system of claim 1 wherein the plunger assembly includes a plunger actuator for actuating the plunger assembly, the plunger actuator having a first end extending through the lid portion of the housing with a button mounted on the first end of the plunger actuator.

8. The flare dispenser system of claim 1 wherein the plunger assembly includes a push member for pushing a flare positioned adjacent to the dispensing opening through the dispensing opening, the push member extending substantially parallel to the side wall adjacent to the dispensing opening, the push member having a first end for pushing against a flare positioned above the dispensing opening, the push member having a second end with a push plate mounted thereon, the push plate being positioned such that the second end of the plunger actuator is abuttable against the push plate for moving the push member upon actuation of the plunger actuator.

9. The flare dispenser system of claim 8 additionally comprising a support structure for supporting the plunger assembly in the housing, the support structure having a first wall and a second wall, the first and second walls forming a chamber with one of the side walls and one of the end walls of the housing, and a support wall extending in a plane oriented perpendicular to a longitudinal axis of the push member, the push member extending through the support wall.

10. The flare dispenser system of claim 9 wherein the ejecting assembly includes a biasing element for biasing the push member in a direction away from the dispensing opening, the biasing element is positioned between the support wall and the push plate for biasing the push plate away from the support wall.

11. A flare dispenser system for storing and dispensing flares, the system comprising:

a housing for holding a plurality of flares for dispensing, the housing having an interior, the housing having a base portion and a lid portion, the base portion having side walls, end walls and a bottom wall joining the end walls and side walls, the housing having a dispensing opening in the bottom wall, a dispensing plate for covering a portion of the dispensing opening, the dispensing plate being pivotally mounted to the housing adjacent to an end of the dispensing opening, the dispensing plate having a closed position adjacent to the dispensing opening for preventing flare movement through the dispensing opening and the dispensing plate being pivotable away from the dispensing opening to permit a flare to pass through the dispensing opening;

an ejecting assembly in the housing for ejecting flares from the housing, the ejecting assembly including a plunger assembly for pushing a flare through the dispensing opening and past the dispensing plate;

wherein the dispensing plate has an inner surface facing the dispensing opening, the inner surface having an abrasive texture for abrading the end of a flare passing through the dispensing opening for igniting the flare as the flare is ejected from the interior of the housing;

a guide wall extending from a second one of the side walls toward the first side wall, the guide wall sloping downwardly toward the dispensing opening such that flares resting on the guide wall are directed toward the dispensing opening;

wherein the guide wall defines a flare dispensing space above the guide wall and a flare storage space between the guide wall and the bottom wall of the housing, the guide wall being pivotally attached to the bottom wall to permit pivoting of the guide wall to access the flare storage space.

12. The flare dispenser system of claim 11 additionally comprising a biasing assembly for biasing flares in the interior of the housing toward a first one of the end walls of the housing, the biasing assembly comprising a biasing wall oriented substantially parallel to the end walls, the biasing wall being oriented above the guide wall for contacting flares resting on the guide wall.

13. The flare dispenser system of claim 12 wherein the biasing wall has opposite side edges, each of the side edges of the guide wall having a guide tab extending from the side edge, the side walls of the housing each having a guide slot for accepting one of the guide tabs of the guide wall for guiding the biasing wall in a path substantially parallel to the guide wall.

14. The flare dispenser system of claim 13 additionally comprising a biasing member located between one of the end walls of the housing and the biasing wall for pressing the biasing wall toward the other of the end walls.

15. A flare dispenser system for storing and dispensing flares, the system comprising:

a housing for holding a plurality of flares for dispensing, the housing having an interior, the housing having a base portion and a lid portion, the base portion having side walls, end walls and a bottom wall joining the end walls and side walls, the housing having a dispensing opening in the bottom wall, a dispensing plate for covering a portion of the dispensing opening, the dispensing plate being pivotally mounted to the housing adjacent to an end of the dispensing opening, the dispensing plate having a closed position adjacent to the dispensing opening for preventing flare movement through the dispensing opening and the dispensing plate being pivotable away from the dispensing opening to permit a flare to pass through the dispensing opening;

an ejecting assembly in the housing for ejecting flares from the housing, the ejecting assembly including a plunger assembly for pushing a flare through the dispensing opening and past the dispensing plate;

wherein the dispensing plate has an inner surface facing the dispensing opening, the inner surface having an abrasive texture for abrading the end of a flare passing through the dispensing opening for igniting the flare as the flare is ejected from the interior of the housing;

wherein the plunger assembly includes a push member for pushing a flare positioned adjacent to the dispensing opening through the dispensing opening, the push member extending substantially parallel to the side wall adjacent to the dispensing opening, the push member having a first end for pushing against a flare positioned above the dispensing opening, the push member having a second end with a push plate mounted thereon, the push plate being positioned such that the second end of the plunger actuator is abuttable against the push plate for moving the push member upon actuation of the plunger actuator.

16. The flare dispenser system of claim 15 additionally comprising a support structure for supporting the plunger assembly in the housing, the support structure having a first wall and a second wall, the first and second walls forming a chamber with one of the side walls and one of the end walls of the housing, and a support wall extending in a plane oriented perpendicular to a longitudinal axis of the push member, the push member extending through the support wall.

17. The flare dispenser system of claim 16 wherein the ejecting assembly includes a biasing element for biasing the push member in a direction away from the dispensing opening, the biasing element is positioned between the support wall and the push plate for biasing the push plate away from the support wall.

18. A flare dispenser system for storing and dispensing flares, the system comprising:

a housing for holding a plurality of flares for dispensing, the housing having an interior, the housing having a base portion and a lid portion, the base portion having a pair of spaced side walls and a pair of spaced end walls extending between the side walls, a bottom wall joining the end walls and side walls, a carrying handle mounted on a top surface of the lid portion for permitting lifting of the housing, a hinge assembly for pivotally coupling the lid portion to the base portion, the hinge assembly being mounted on one of the end walls of the base portion of the housing and a first end of the lid portion, a latch assembly for selectively securing the lid portion to the base portion in a closed position, the latch assembly being mounted on an end wall of the housing opposite the end all on which the hinge assembly is mounted, the latch assembly being mounted on an end of the lid portion opposite the end on which the hinge assembly is mounted;

a dispensing opening in the bottom wall adjacent to a first one of the side walls;

a guide wall extending from a second one of the side walls toward the first side wall, the guide wall sloping downwardly toward the dispensing opening such that flares resting on the guide wall are directed toward the dispensing opening, the guide wall defining a flare dispensing space above the guide wall and a flare storage space between the guide wall and the bottom wall, the guide wall being pivotally attached to the bottom wall to permit pivoting of the guide wall to access the flare storage space, a dispensing plate for covering a portion of the dispensing opening, the dispensing plate being pivotally mounted to the housing adjacent to an end of the dispensing opening, the dispensing plate having a closed position adjacent to the dispensing opening for preventing flare movement through the dispensing opening, the dispensing plate being pivotable away from the dispensing opening to permit a flare to pass through the dispensing opening, the dispensing plate having an inner surface facing the dispensing opening, the inner surface having an abrasive texture for abrading the end of a flare passing through the dispensing opening, a retaining plate positioned at an end of the dispensing opening opposite the dispensing plate, the retaining plate supporting an end of a flare positioned above the dispensing opening, the retaining plate being pivotally mounted to the bottom wall of the housing adjacent to the end of the dispensing opening;

a biasing assembly for biasing flares in the interior of the housing toward a first one of the end walls of the housing, the biasing assembly comprising a biasing wall oriented substantially parallel to the end walls, the biasing wall being oriented above the guide wall for contacting flares resting on the guide wall, the biasing wall having opposite side edges, each of the side edges of the guide wall having a guide tab extending from the side edge, the side walls of the housing each having a guide slot for accepting one of the guide tabs of the guide wall, a biasing member located between a second one of the end walls and the biasing wall for pressing the biasing wall toward the first end wall, a pair of biasing members extending between the second end wall and the biasing wall, wherein the biasing member comprises a compression spring, an ejecting assembly for ejecting flares from the housing, the a plunger assembly for pushing a flare through the dispensing opening;

a plunger actuator for actuating the plunger assembly, the plunger actuator having a first end extending through the lid portion of the housing with a button mounted on the first end of the plunger actuator, the plunger actuator having a second end extending into the housing;

a push member for pushing a flare positioned adjacent to the dispensing opening through the dispensing opening, the push member extending substantially parallel to the side wall adjacent to the dispensing opening, the push member having a first end for pushing against a flare positioned above the dispensing opening, the push member having a second end with a push plate mounted thereon, the push plate being positioned such that the second end of the plunger actuator is abuttable against the push plate for moving the push member upon actuation of the plunger actuator;

a biasing element for biasing the push member in a direction away from the dispensing opening; and a support structure for supporting the plunger assembly in the housing, the support structure having a first wall and a second wall, the first and second walls forming a chamber with a side wall and an end wall of the housing, a support wall extending in a plane oriented perpendicular to a longitudinal axis of the push member, the push member extending through the support wall, the biasing element being positioned between the support wall and the push plate for biasing the push plate away from the support wall.

19. A flare dispenser system for storing and dispensing flares, the system comprising:

a housing for holding a plurality of flares for dispensing, the housing having an interior, the housing having a base portion and a lid portion, the base portion having side walls, end walls and a bottom wall joining the end walls and side walls, the housing having a dispensing opening in the bottom wall, a dispensing plate for covering a portion of the dispensing opening, the dispensing plate being pivotally mounted to the housing adjacent to an end of the dispensing opening, the dispensing plate having a closed position adjacent to the dispensing opening for preventing flare movement through the dispensing opening and the dispensing plate being pivotable away from the dispensing opening to permit a flare to pass through the dispensing opening;

an ejecting assembly in the housing for ejecting flares from the housing, the ejecting assembly including a plunger assembly for pushing a flare through the dispensing opening and past the dispensing plate; and a hinge assembly for pivotally coupling the lid portion to the base portion, a latch assembly for selectively securing the lid portion to the base portion in a closed position, and a carrying handle mounted on a top surface of the lid portion for permitting lifting of the housing;

wherein the dispensing plate has an inner surface facing the dispensing opening, the inner surface having an abrasive texture for abrading the end of a flare passing through the dispensing opening for igniting the flare as the flare is ejected from the interior of the housing.

* * * * *